US009205897B2

(12) United States Patent
Wang et al.

(10) Patent No.: US 9,205,897 B2
(45) Date of Patent: Dec. 8, 2015

(54) C-SEMI WITH MINIMUM HYDRODYNAMIC FORCES

(75) Inventors: Tao Wang, Katy, TX (US); Yijian Zeng, Katy, TX (US)

(73) Assignee: AKER SOLUTIONS INC., Houston, TX (US)

( * ) Notice: Subject to any disclaimer, the term of this patent is extended or adjusted under 35 U.S.C. 154(b) by 171 days.

(21) Appl. No.: 13/988,714

(22) PCT Filed: Nov. 22, 2011

(86) PCT No.: PCT/US2011/061834

§ 371 (c)(1), (2), (4) Date: Aug. 13, 2013

(87) PCT Pub. No.: WO2012/071407

PCT Pub. Date: May 31, 2012

(65) Prior Publication Data

US 2013/0319314 A1 Dec. 5, 2013

Related U.S. Application Data

(60) Provisional application No. 61/416,570, filed on Nov. 23, 2010.

(51) Int. Cl.
*B63B 35/44* (2006.01)
*B63B 1/10* (2006.01)

(52) U.S. Cl.
CPC ..... *B63B 35/4413* (2013.01); *B63B 1/107* (2013.01)

(58) Field of Classification Search
USPC ..... 114/264–266
IPC ..... B63B 35/4413,35/44, 1/107
See application file for complete search history.

(56) References Cited

U.S. PATENT DOCUMENTS

| | | | | |
|---|---|---|---|---|
| 3,717,113 | A * | 2/1973 | Wilde | 114/264 |
| 2004/0040487 | A1* | 3/2004 | Kristensen et al. | 114/265 |
| 2005/0058513 | A1* | 3/2005 | Martensson et al. | 405/203 |
| 2006/0067793 | A1* | 3/2006 | Murray | 405/205 |
| 2012/0111256 | A1* | 5/2012 | Xu | 114/265 |

* cited by examiner

*Primary Examiner* — Stephen Avila
(74) *Attorney, Agent, or Firm* — Rothwell, Figg, Ernst & Manbeck, P.C.

(57) ABSTRACT

An offshore floating structure (10) for the drilling and production of oil and gas includes a generally circular toroidal, hollow pontoon (11) of substantially the same radial width throughout a perimeter of the pontoon. The offshore floating structure includes a plurality of columns (12) of substantially a same cross-sectional area, each coupled at a coupling point, on a bottom end thereof to the pontoon at an equidistant point along the perimeter of the pontoon, and adapted to be coupled on a top end to a deck structure. The diameter (23) from a center of the radial width of the pontoon is greater than a distance (21) from a center of one column to a center of an adjacent column.

10 Claims, 15 Drawing Sheets

C-SEMI WITH MINIMUM HYDRODYNAMIC FORCES

CLAIM OF PRIORITY OR CROSS-REFERENCE TO RELATED APPLICATION

This application is a 35 U.S.C. §371 National Phase Entry Application from PCT/US2011/061834, filed Nov. 22, 2011, and designating the U.S., which claims the benefit of priority to Provisional Patent Application Ser. No. 61/416,570, filed Nov. 23, 2010, the contents of which are incorporated herein by reference in their entirety.

FIELD OF THE INVENTION

The present invention relates generally to an offshore floating platform for the drilling and production of oil and gas. Specifically, the invention relates to a circular cylindrical semi-submersible platform (C-Semi) for offshore drilling and production.

BACKGROUND OF THE INVENTION

Floating structures used for offshore oil and gas drilling and production are known. One such floating structure is conventional semi-submersible hulls. A conventional semi-submersible hull has a square pontoon structure. The square pontoon structure is coupled to four square shaped columns placed at the four corners of the pontoon structure. Therefore, the pontoon section length is the same as the length separating the columns.

In a conventional semi-submersible hull, the columns do not have strakes. Each column is connected to a deck structure to support topside facilities. A spread mooring or dynamic positioning system is used for station keeping.

Conventional semi-submersible hulls have several limitations. They are subject to large heave, roll and pitch motions. A conventional semi-submersible hull is unable to support steel catenary risers in extreme weather conditions. These steel catenary risers also have fatigue problems in long term operating conditions. Furthermore, a conventional semi-submersible hull is unable to be used for dry tree production applications while undergoing these motions.

There are also known variants of this structure that alter the draft and the column distance of the floating platform. In traditional structures, the length of the pontoon structure is considerably larger than the draft. In an attempt to reduce the effects of motions experienced in extreme and operating weather conditions, structures were developed with an increased draft and/or modified column distance. However, these deep draft variants are still operationally limited.

Another type of known floating structure is an extendable draft platform (EDP). An EDP structure includes a buoyant equipment deck. The buoyant equipment deck is either rectangular or triangular. Column wells are coupled to each corner of the buoyant equipment. On an opposite end, the columns are coupled to a heave plate. In an EDP structure, each of the columns has an upper portion with a diameter that is different from that of a lower portion, which is usually smaller. The columns can move vertically in the column well to adjust the draft.

EDP structures have several limitations. EDP structures are difficult to manufacture and maintain because they use complex, large moving components. Additionally, strong subsurface currents can cause vortex-induced vibrations (VIV).

A structure that has prolonged exposure to VIV can experience fatigue damage to components and is subject to structural failure.

A dual column semi-submersible hull is a known floating structure as well. A dual column semi-submersible hull has a deck structure that is supported by vertical columns arranged in pairs. In these structures, one set of the paired columns is displaced a distance outward from the other set of paired columns. The other set of paired columns is in line with a pontoon structure. The lower ends of this set of vertical columns are connected to the pontoon structures.

The dual column semi-submersible hull, at a much deeper draft, has better performance than a conventional semi-submersible hull at a much shallower draft. However, at the same draft, the dual column semi-submersible hull only marginally improves the motions of a conventional semi-submersible hull. In addition, the dual columns complicate design, fabrication and operation.

There is also a central pontoon semi-submersible floating platform. The central pontoon structure is disposed inboard of the columns, with each of said vertical support columns having a transverse cross sectional shape with a horizontal major axis oriented radially outward from a center point of said hull. However, the vertical wave force on the central pontoon not substantially cancelled by the forces on the columns. This arrangement has adverse effects, and can result in worse vertical motions than a conventional semi-submersible hull at the same draft.

The other known semi-submersible is octabuoy. The draft of octabuoy is substantially greater than the distance between the columns' central axes. The columns have quite large diameter relative to the length of pontoon section, and the pontoon section length is around 2 times column diameter. As a result, the column displacement is a few times greater than the pontoon displacement, and the wave forces on the columns will make a greater contribution than the force on the pontoon. The most preferred draft of octabuoy is at least 60 meters, and the most preferred ratio of draft to the distance between central axes of columns is 1.3 to 1.35. The substantially deep draft required makes it cannot integrate topsides at quaysides because of water depth limitations. Additionally, float over operations near the shore are required. The nonlinear shape and variant cross section of columns also increases fabrication complexity.

Therefore, for the drilling and production of offshore oil and gas, there is a need for a simple floating structure that is subject to minimized environmental forces and platform motions compared with known semi-submersibles.

SUMMARY OF THE INVENTION

According to an embodiment of the present invention, a C-Semi floating platform for offshore production and drilling includes a generally circular toroidal, hollow pontoon, a plurality of columns, a deck structure, and topside facilities. The circular cylindrical pontoon can be comprised of straight and curved sections. The diameter from a center of the radial width of the pontoon is larger than the distance from one column center to an adjacent column center. At the intersection points of columns and pontoon, the cross-sectional area of columns is generally greater than, but can be equal to or less than, the corresponding area of pontoon. The columns have a cross section that is either circular or square with rounded corners. If desired, each column can be provided with overlapping helical strakes, which extend across the entirety of the column perimeter below the waterline.

In one embodiment of the present invention, the offshore floating structure for the drilling and production of oil and gas includes a generally circular toroidal, hollow pontoon of substantially the same radial width throughout a perimeter of the pontoon. The offshore floating structure includes a plurality of columns of substantially a same cross-sectional area, each coupled at a coupling point, on a bottom end thereof to the pontoon at an equidistant point along the perimeter of the pontoon, and adapted to be coupled on a top end to a deck structure. The diameter from a center of the radial width of the pontoon is greater than a distance from a center of one column to a center of an adjacent column.

According to another embodiment of the present invention, the offshore floating structure is a hollow, oval toroidal pontoon of substantially a same radial width throughout the perimeter of the pontoon. The offshore floating structure includes four large columns of substantially a same cross-sectional area, each coupled on a bottom end thereof to the pontoon at an equidistant point along the perimeter of the pontoon forming two non-shortest diameters. Each large column is also adapted to be coupled on a top end to a deck structure. The offshore drilling structure also includes two small columns of substantially a same cross-sectional area, each coupled on a bottom end thereof to the pontoon at an equidistant point along the perimeter of the pontoon forming the shortest diameter. Each small column is also adapted to be coupled on a top end to a deck structure.

According to another embodiment of the present invention, the offshore floating structure is a hollow, rectangular cuboid pontoon of substantially a same radial width throughout a perimeter of the pontoon. The offshore floating structure includes four columns of substantially a same cross-sectional area, each coupled on a bottom end thereof to the pontoon at the center of each side of the pontoon. Each column is also adapted to be coupled on a top end to a deck structure.

The present invention offers utility for semi-submersible drilling and production units including wet trees with steel catenary risers (SCR) and/or dry trees with top tensioned risers (TTR). Additionally, the C-Semi hull is applicable for Tension Leg Platforms (TLPs).

The C-Semi offers several advantages, including minimized wave, current and vortex induced motions, and structural forces. These advantages significantly improve hull, mooring and riser system performance. Additionally, the present invention reduces the costs and risks typically in offshore oil and gas field development.

Further features and advantages of the present invention shall be understood in view of the following description with reference to the drawing figures.

BRIEF DESCRIPTION OF THE DRAWINGS

While the present invention may be embodied in many different forms, a number of illustrative embodiments are described herein with reference to the accompanying figures. The skilled person should understand that the present disclosure is to be considered as providing examples of the principles of the invention, and such examples are not intended to limit the invention to the preferred embodiment described herein and/or illustrated herein.

DETAILED DESCRIPTION OF THE INVENTION

Figure 1:
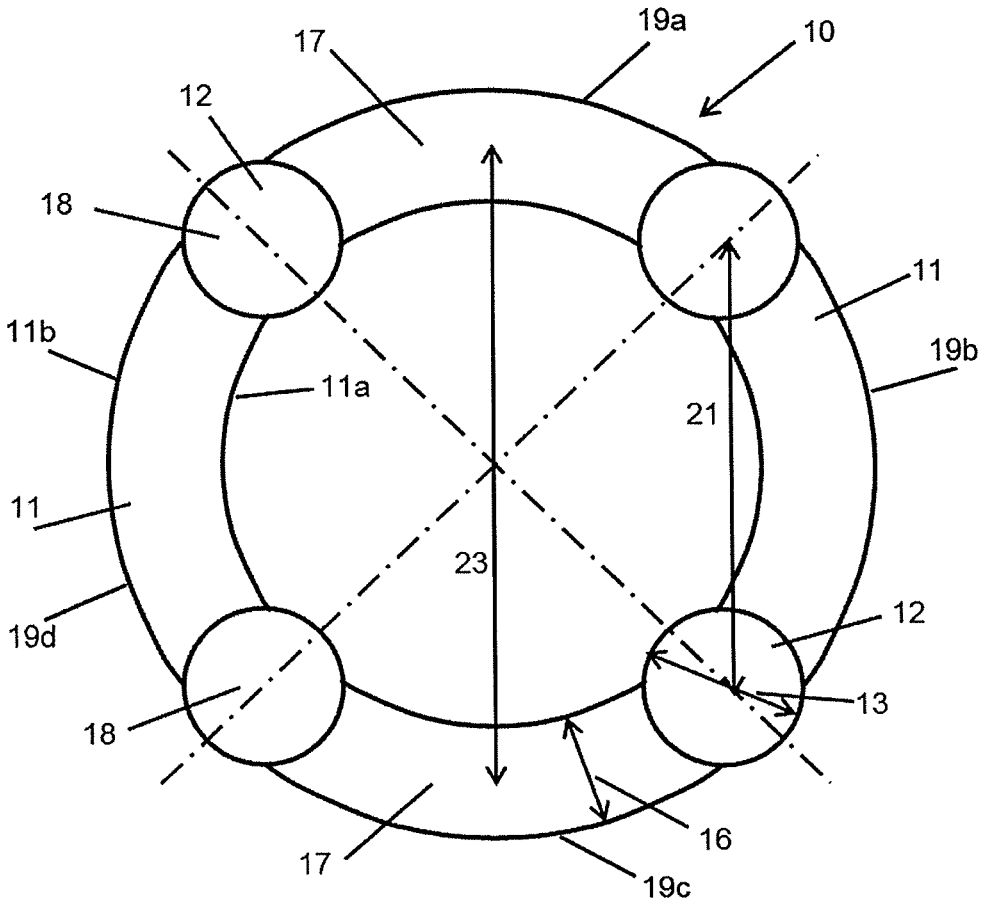
FIG. 1 is a plan view of a C-Semi, according to an embodiment of the present invention.

FIG. 1 is a plan view of a C-semi 10 with a circular cylindrical pontoon 11 according to an embodiment of the present invention. As shown, the four circular cylindrical columns 12 are coupled to the pontoon 11 at points along the perimeter of the pontoon 11 equidistant from each other. While the pontoon 11 may be a single structure or several separate structures, for ease in description, the pontoon 11 will be referred to as having four sections or quadrants 19*a*, 19*b*, 19*c* and 19*d*; each section is coupled to and positioned between two adjacent columns 12. The pontoon 11 is a circular, hollow toroid with an interior edge 11*a* and an exterior edge 11*b*. The pontoon can be filled with buoyant material such as air, or ballast such as water.

In this embodiment, parts of each column 12 can extend radially beyond the interior and exterior edges of the pontoon 11. The maximum width (in this case the diameter) 13 of the columns 12 is larger than the radial width 16 of the pontoon 11. Therefore, at the point where the column 12 intersects the pontoon 11, the cross-sectional area of each column 12 is greater than the corresponding area of the pontoon 11. The diameter from the center of the radial width of one pontoon section 17 to the center of the radial width of an opposite pontoon section 17 is larger than the distance from the center of one column 18 to the center of an adjacent column 18. A spread mooring (not shown) can be used for station keeping of the C-Semi.

Figure 2:
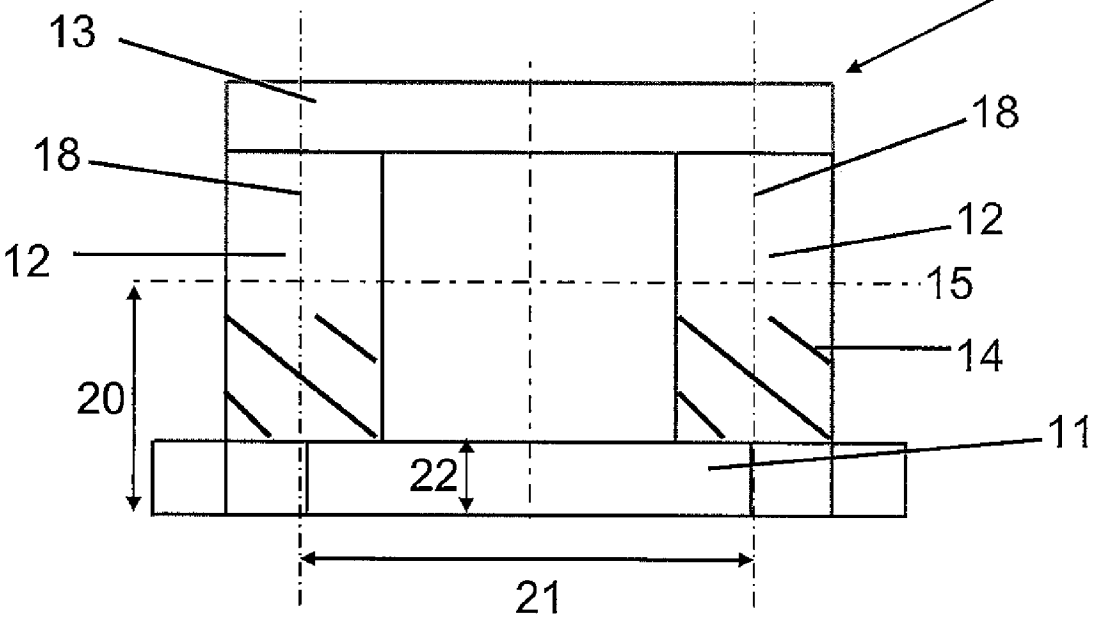
FIG. 2 is an elevation view of a C-Semi, according to an embodiment of the present invention.

FIG. 2 is an elevation view of the C-Semi 10 with a circular cylindrical pontoon 11 according to this embodiment of the present invention. A deck structure 13 can be connected to the top end of columns 12. Strakes 14 can be provided on the exterior of the columns 12 below the mean waterline 15 to mitigate vortex induced motions. The columns 12 can be attached to the pontoon 11 on the end opposite the deck structure 13.

The pontoon sections are positioned radially outward relative to the columns. The diameter 23 from the center of the radial width of one pontoon section 17 to the center of the radial width of an opposite pontoon section 17 is preferably between 1.2 to 1.5 times the distance 21 from the center of one column 18 to the center of an adjacent column 18. The pontoon sections are substantially longer relative to the column width 13, and the distance 21 between central axes of adjacent columns is preferably 3.5 to 4 times the column width 13. The preferred draft 20 is generally between 20 to 50 meters. The draft is between 0.3 and 1 times the distance 21 from the center of one column 18 to the center of an adjacent column 18. The draft is also typically much less than the distance 21 between central axes of adjacent columns. The pontoon width 16 varies from 0.6 to 1 times the column width 13. The preferred pontoon height 22 is in the range of 0.4 to 0.8 times the pontoon width 16. The column displacement is between 0.8 to 2 times the pontoon displacement. The wave forces on the columns contribute less than the force on the pontoon for most wave periods.

Figure 3:
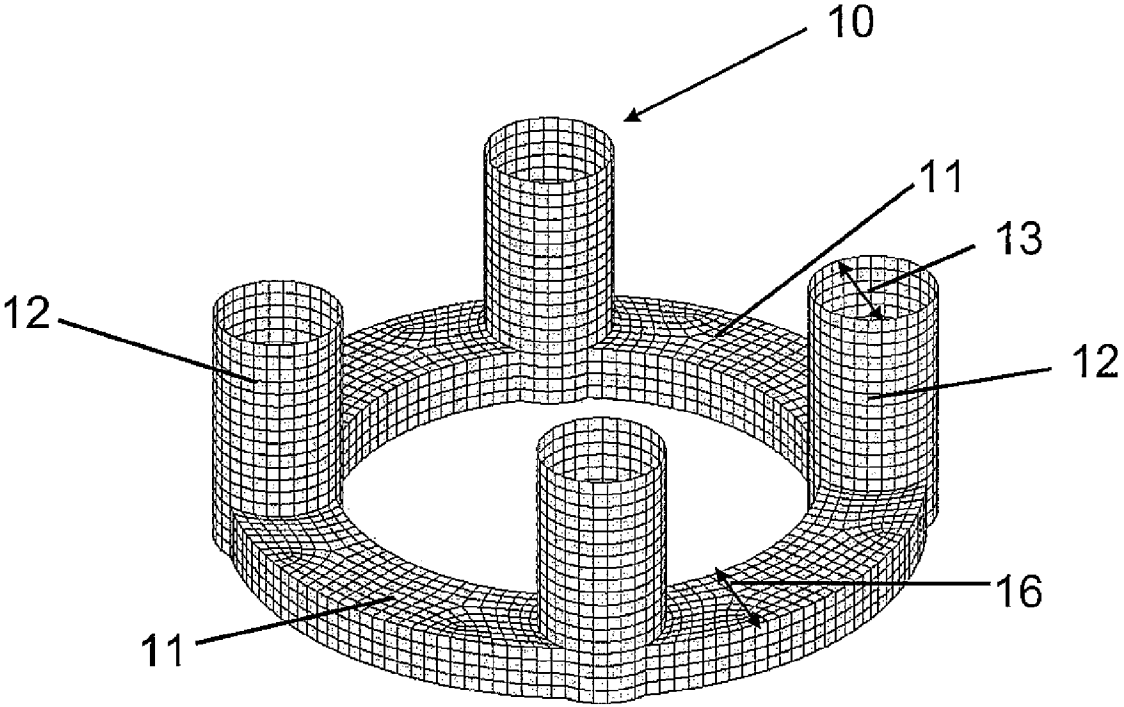
FIG. 3 is a perspective view of a C-semi, according to an embodiment of the present invention.

FIG. 3 is a perspective view of the C-semi 10 with a circular cylindrical pontoon 11 according to this embodiment of the present invention. As shown, the four circular cylindrical columns 12 can be coupled to the pontoon 11 at equidistant points along the pontoon 11.

Figure 4:
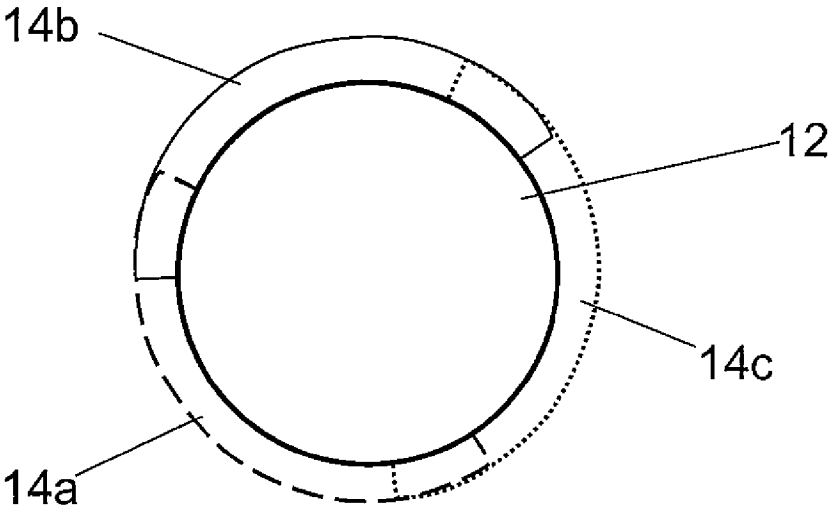
FIG. 4 is a detailed view of an individual column with strakes, according to another embodiment of the present invention.

FIG. 4 is a plan view of an individual column 12 according to another embodiment of the present invention. The exterior of each column can be provided with three overlapping helical strakes 14*a*, 14*b* and 14*c*, which fully cover the column 12 perimeter below the waterline.

Figure 5:
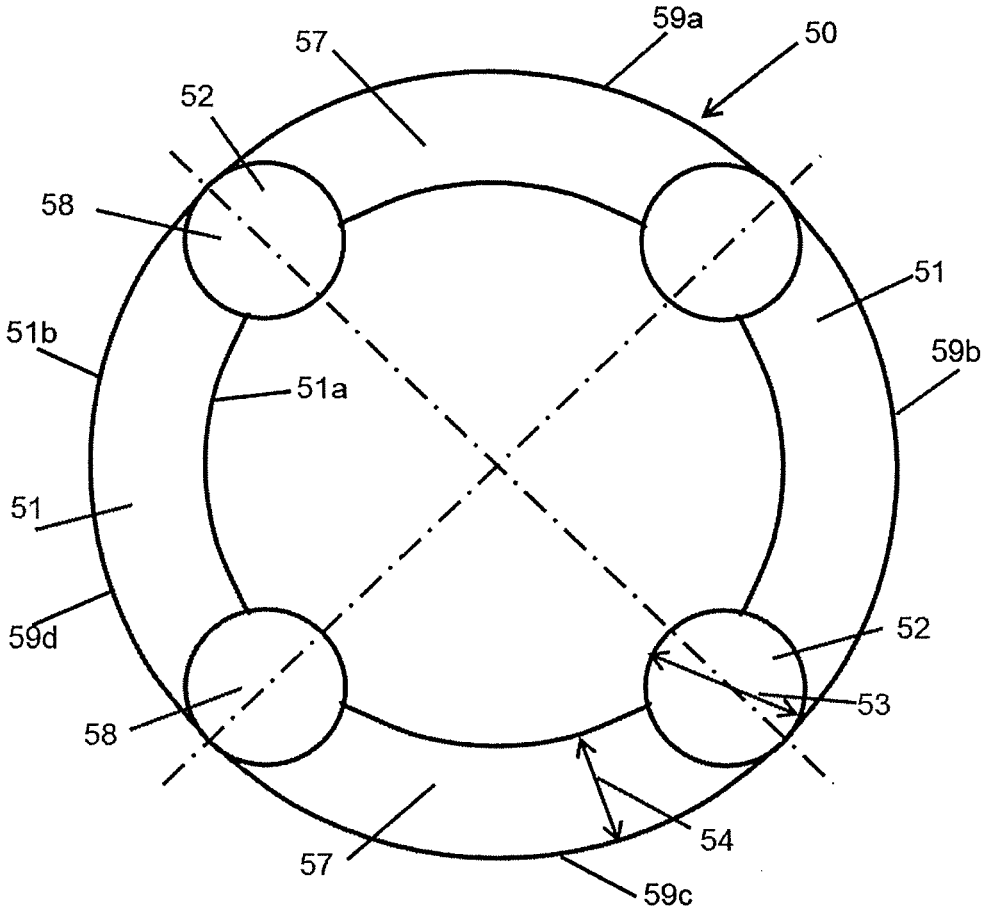
FIG. 5 is a plan view of a C-Semi with the pontoon offset to the outside, according to another embodiment of the present invention.

FIG. 5 is a plan view of a C-Semi 50 with a circular cylindrical pontoon 51 according to another embodiment of the present invention. As shown, the four circular cylindrical columns 52 can be coupled to the pontoon 51 at points along the perimeter of the pontoon 51 equidistant from each other. The pontoon 51 is a is a circular, hollow toroid with an interior edge 51*a* and an exterior edge 51*b*.

While the pontoon 51 may be a single structure or several separate structures, for ease in description, the pontoon 51 will be referred to as having four sections or quadrants 59*a*, 59*b*, 59*c* and 59*d*; each section is coupled to two adjacent columns 58. As shown, the maximum width (in this case the diameter) 53 of the columns 52 is larger than the radial width 54 of the pontoon 51. Therefore, at the point where the column 52 intersects the pontoon 51, the cross-sectional area of each column 52 is greater than the corresponding area of the pontoon 51. In this embodiment, as shown, parts of each column 52 extend radially beyond only the interior edge 51*a* of the pontoon 51. The edge of a column 52 can be in line with the outer circumferential edge of the pontoon 51. The diameter from the center of the radial width of one pontoon section 57 to the center of the radial width of an opposite pontoon section 57 is larger than the distance from the center of one column 58 to the center of an adjacent column 58.

Figure 6:
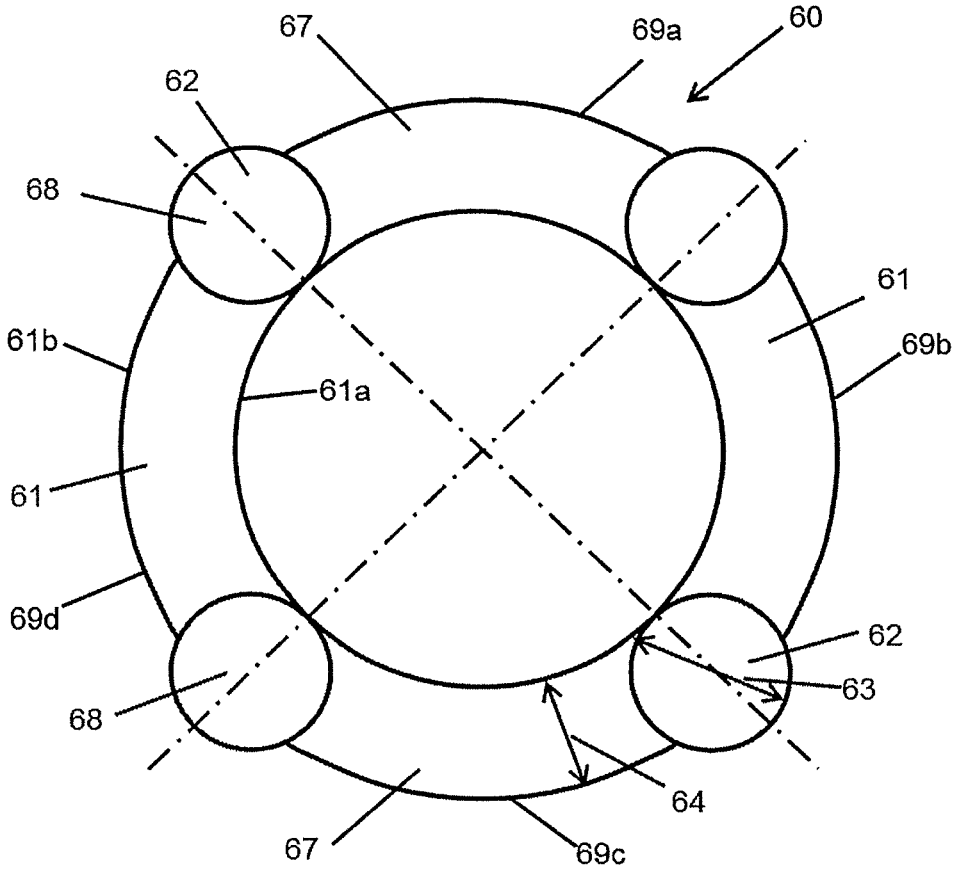
FIG. 6 is a plan view of a C-Semi with the pontoon offset to the inside, according to another embodiment of the present invention.

FIG. 6 is a plan view of a C-Semi 60 with a circular cylindrical pontoon 61 according to another embodiment of the present invention. As shown, the four circular cylindrical columns 62 can be coupled to the pontoon 61 at points along the perimeter of the pontoon 61 equidistant from each other. The pontoon 61 is a circular, hollow toroid with an interior edge 61*a* and an exterior edge 61*b*.

While the pontoon 61 may be a single structure or several separate structures, for ease in description, the pontoon 61 will be referred to as having four sections or quadrants 69*a*, 69*b*, 69*c* and 69*d*; each section is coupled to two adjacent columns 68. The maximum width (in this case the diameter) 63 of the columns 62 is larger than the radial width 64 of the pontoon 61. Therefore, at the point where the column 62 intersects the pontoon 61, the cross-sectional area of each column 62 is greater than the corresponding area of the pontoon 61. In this embodiment, as shown, parts of each column 62 extend radially beyond only the exterior edge 61*b* of the pontoon 61. The diameter from the center of the radial width of one pontoon section 67 to the center of the radial width of an opposite pontoon section 67 is larger than the distance from the center of one column 68 to the center of an adjacent column 68.

Figure 7:
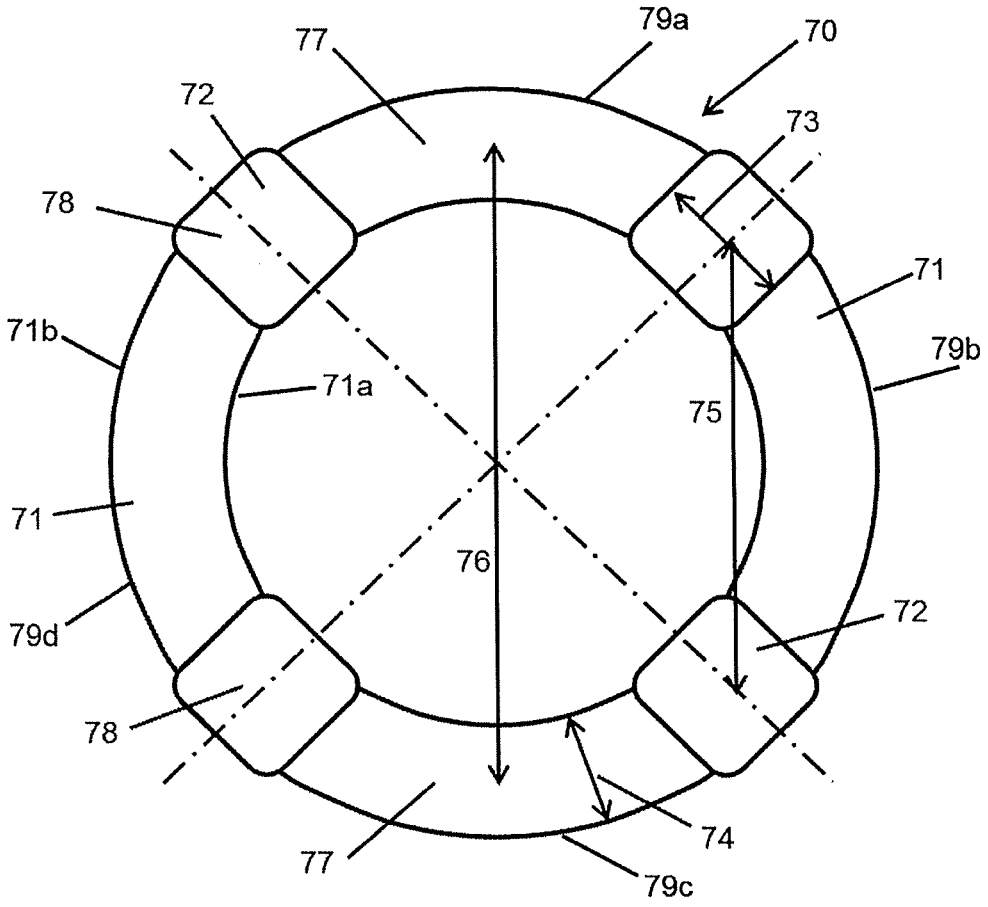
FIG. 7 is a plan view of a C-Semi with square columns, according to another embodiment of the present invention.

FIG. 7 is a plan view of a C-Semi 70 with a circular cylindrical pontoon 71 according to another embodiment of the present invention. As shown, the four square cylindrical columns 72 with round corners can be coupled to the pontoon 71 at points along the perimeter of the pontoon 71 equidistant from each other. The pontoon 71 is a circular, hollow toroid with an interior edge 71*a* and an exterior edge 71*b*.

While the pontoon 71 may be a single structure or several separate structures, for ease in description, the pontoon 71 will be referred to as having four sections or quadrants 79*a*, 79*b*, 79*c* and 79*d*; each section is coupled to two adjacent columns 78. The maximum width 73 of the columns 72 is larger than the radial width 74 of the pontoon 71. Therefore, at the point where the column 72 intersects the pontoon 71, the cross-sectional area of each column 72 is greater than the corresponding area of the pontoon 71. In this embodiment, as shown, parts of each column 72 extend radially beyond only the exterior edge 71*b* of the pontoon 71. The diameter from the center of the radial width of one pontoon section 77 to the center of the radial width of an opposite pontoon section 77 is larger than the distance from the center of one column 78 to the center of an adjacent column 78.

The pontoon sections are positioned radially outward relative to the columns. The diameter 76 from the center of the radial width of one pontoon section 77 to the center of the radial width of an opposite pontoon section 77 is preferably between 1.2 to 1.5 times the distance 75 from the center of one column 78 to the center of an adjacent column 78. The pontoon sections are substantially longer relative to the column width 73, and the distance 75 between central axes of adjacent columns is preferably 3.5 to 4 times the column width 73. The preferred draft is generally between 20 to 50 meters. The draft is between 0.3 and 1 times the distance 75 from the center of one column 18 to the center of an adjacent column 78. The draft is also typically much less than the distance 75 between central axes of adjacent columns. The pontoon width 74 varies from 0.6 to 1 times the column width 73. The preferred pontoon height is in the range of 0.4 to 0.8 times the pontoon width 74. The column displacement is between 0.8 to 2 times the pontoon displacement. The wave forces on the columns contribute less than the force on the pontoon for most wave periods.

Figure 8:
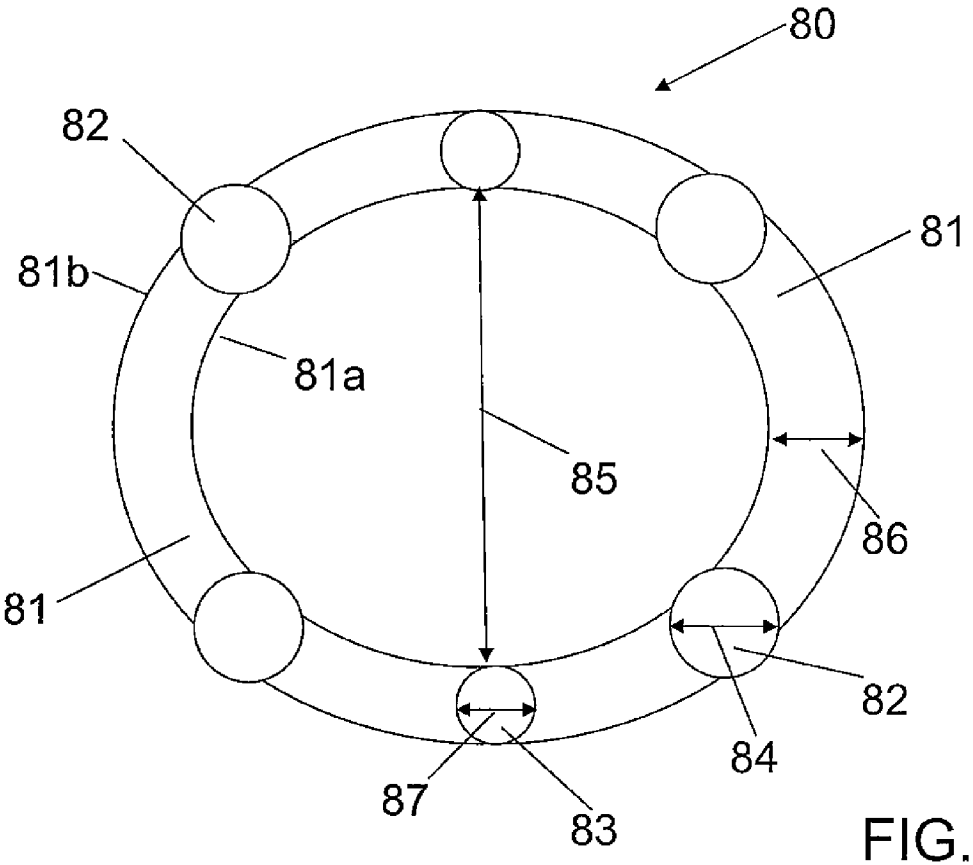
FIG. 8 is a plan view of a C-Semi with six columns, according to another embodiment of the present invention.

FIG. 8 is a plan view of a C-Semi 80 according to another embodiment of the present invention. The pontoon is an oval, hollow toroid with an interior edge 81*a* and an exterior edge 81*b*. As shown, two small cylindrical columns 83 can be coupled to the pontoon 81 such that the distance between the coupling points of the columns and the interior of the pontoon forms the shortest diameter 85 of the oval pontoon 81. The two small cylindrical columns 83 can have a maximum width 87 that is equal to the radial distance 86 from the interior edge

81*a* to the exterior edge 81*b* of the pontoon 81. The other four large columns 82 can be coupled to the oval pontoon 81 at opposite ends of two diameters that do not comprise the shortest diameter of the oval.

The four large columns 82 can have a maximum width 84 that is larger than the radial width 86 of the pontoon 81. Therefore, at the point where these four columns 82 intersect the pontoon 81, the cross-sectional area of each column 82 is greater than the corresponding area of the pontoon 81. In this embodiment, as shown, parts of each column 82 extend radially beyond both the interior edge 81*a* and exterior edge 81*b* of the pontoon 81.

Figure 9:
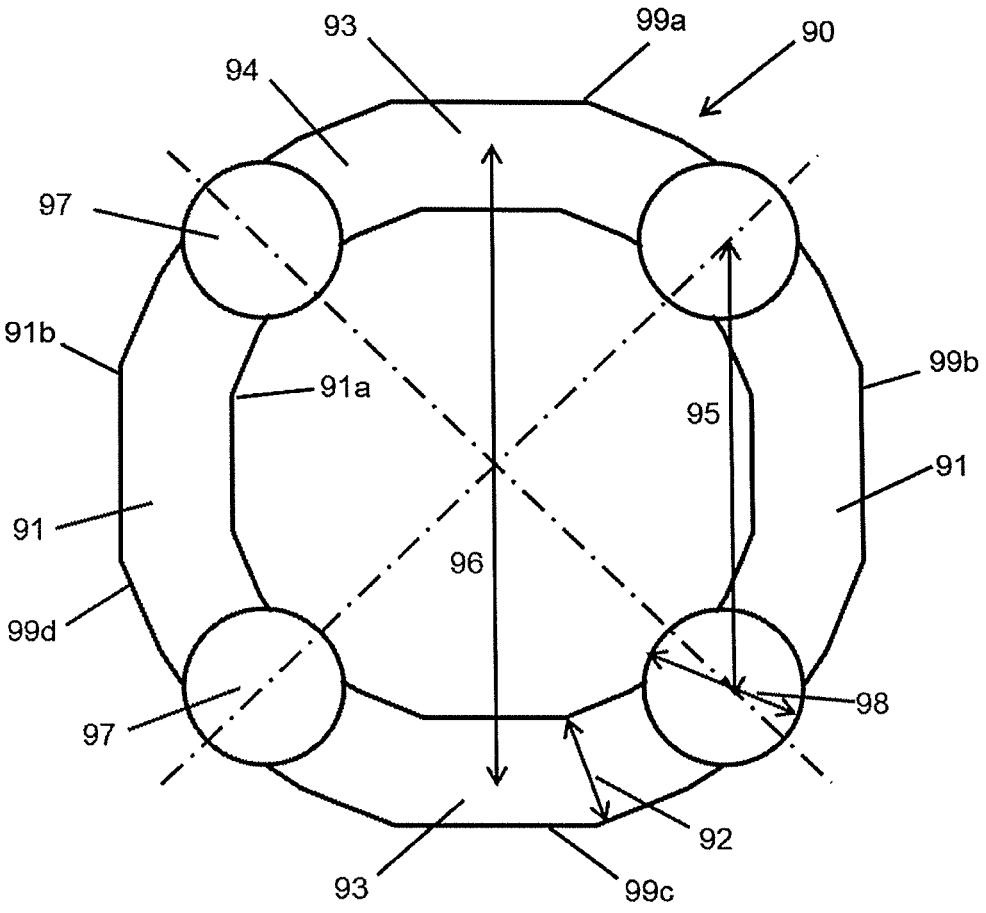
FIG. 9 is a plan view of a C-Semi with straight pontoon middle sections and circular columns, according to another embodiment of the present invention.

FIG. 9 is a plan view of a C-semi 90 according to another embodiment of the present invention. As shown, the four circular cylindrical columns 97 can be coupled to the pontoon 91 at points along the perimeter of the pontoon 91 equidistant from each other.

While the pontoon 91 may be a single structure or several separate structures, for ease in description, the pontoon 91 will be referred to as having four sections or quadrants 99*a*, 99*b*, 99*c* and 99*d*; each section is coupled to two adjacent columns. The pontoon 91 is generally in the shape of a circular, hollow toroid with an interior edge 91*a* and an exterior edge 91*b*. However, each pontoon section or quadrant 99*a*, 99*b*, 99*c* and 99*d* can have linear portions 93 and non-linear portions 94. The linear portions 93 can comprise the center of each pontoon section 99*a*, 99*b*, 99*c* and 99*d*, while the non-linear portions 94 can be nearest to the coupling points of the columns 97 and pontoon 91. The maximum width (in this case the diameter) 98 of the columns 97 is larger than the radial width 95 of the pontoon 91. Therefore, at the point where the column 92 intersects the pontoon 91, the cross-sectional area of each column 92 is greater than the corresponding area of the pontoon 91. In this embodiment, as shown, parts of each column 92 extend radially beyond the interior edge 91*a* and exterior edge 91*b*.

The pontoon sections are positioned radially outward relative to the columns. The diameter 96 from the center of the radial width of one pontoon section 93 to the center of the radial width of an opposite pontoon section 93 is preferably between 1.2 to 1.5 times the distance 95 from the center of one column 97 to the center of an adjacent column 97. The pontoon sections are substantially longer relative to the column width 98, and the distance 95 between central axes of adjacent columns is preferably 3.5 to 4 times the column width 98. The preferred draft is generally between 20 to 50 meters. The draft is between 0.3 and 1 times the distance 95 from the center of one column 98 to the center of an adjacent column 98. The draft is also typically much less than the distance 95 between central axes of adjacent columns. The pontoon width 92 varies from 0.6 to 1 times the column width 98. The preferred pontoon height is in the range of 0.4 to 0.8 times the pontoon width 92. The column displacement is between 0.8 to 2 times the pontoon displacement. The wave forces on the columns contribute less than the force on the pontoon for most wave periods.

Figure 10:
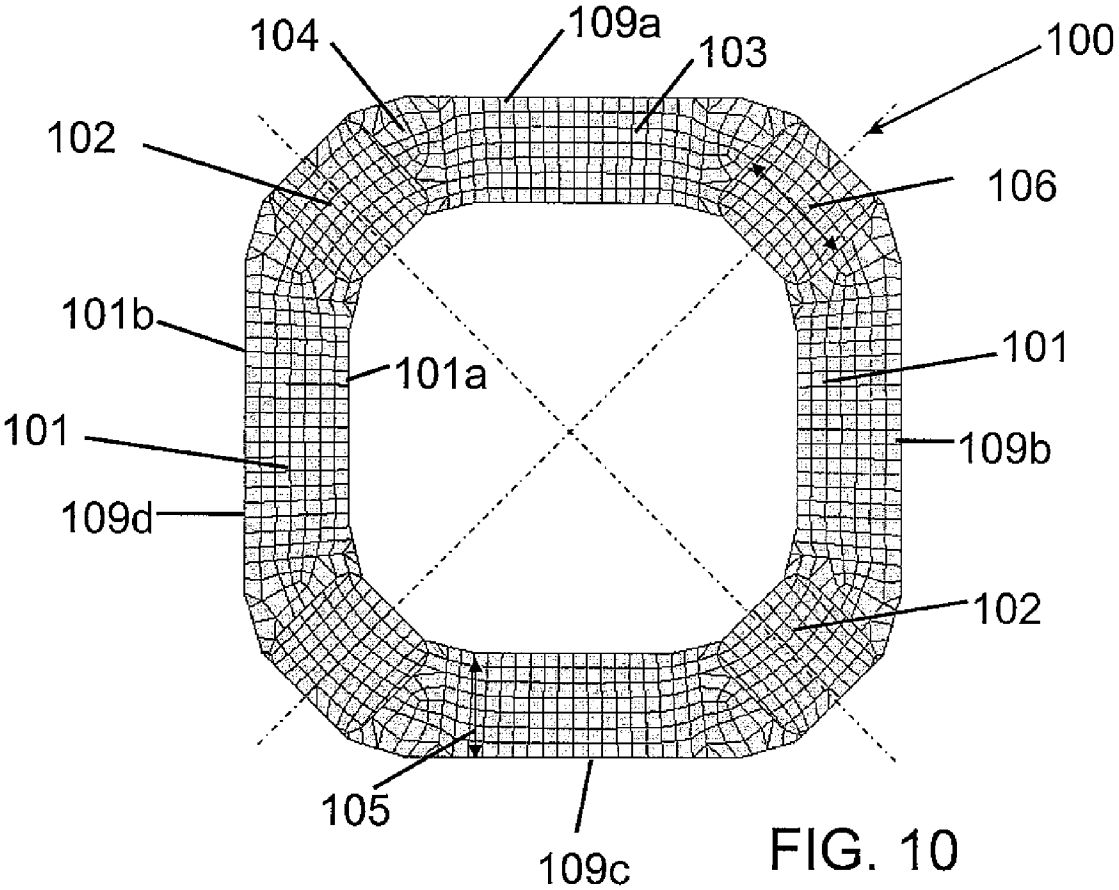
FIG. 10 is a plan view of a C-Semi with straight pontoon middle sections and square columns, according to another embodiment of the present invention.

FIG. 10 is a plan view of a C-semi 100 according to another embodiment of the present invention. As shown, the four square cylindrical columns 102 with round corners can be coupled to the pontoon 101 at points along the perimeter of the pontoon 101 equidistant from each other.

In this embodiment, each of the four columns can be positioned to face the center of the interior of the pontoon structure. While the pontoon 101 may be a single structure or several separate structures, for ease in description, the pontoon 101 will be referred to as having four sections or quadrants 109*a*, 109*b*, 109*c* and 109*d*; each section is coupled to two adjacent columns 102. The pontoon 101 is generally in the shape of a circular, hollow toroid with an interior edge 101*a* and an exterior edge 101*b*. However, each pontoon section 109*a*, 109*b*, 109*c* and 109*d* can have linear portions 103 at the center and non-linear portions 104 nearest to the coupling points of the columns 102 and pontoon 101. The maximum width 106 of the columns 102 is larger than the radial width 105 of the pontoon 101. Therefore, at the point where the column 102 intersects the pontoon 101, the cross-sectional area of each column 102 is greater than the corresponding area of the pontoon 101. In this embodiment, as shown, parts of each column 102 extend radially to flush the interior edge 101*a* and exterior edge 101*b*.

Figure 11:
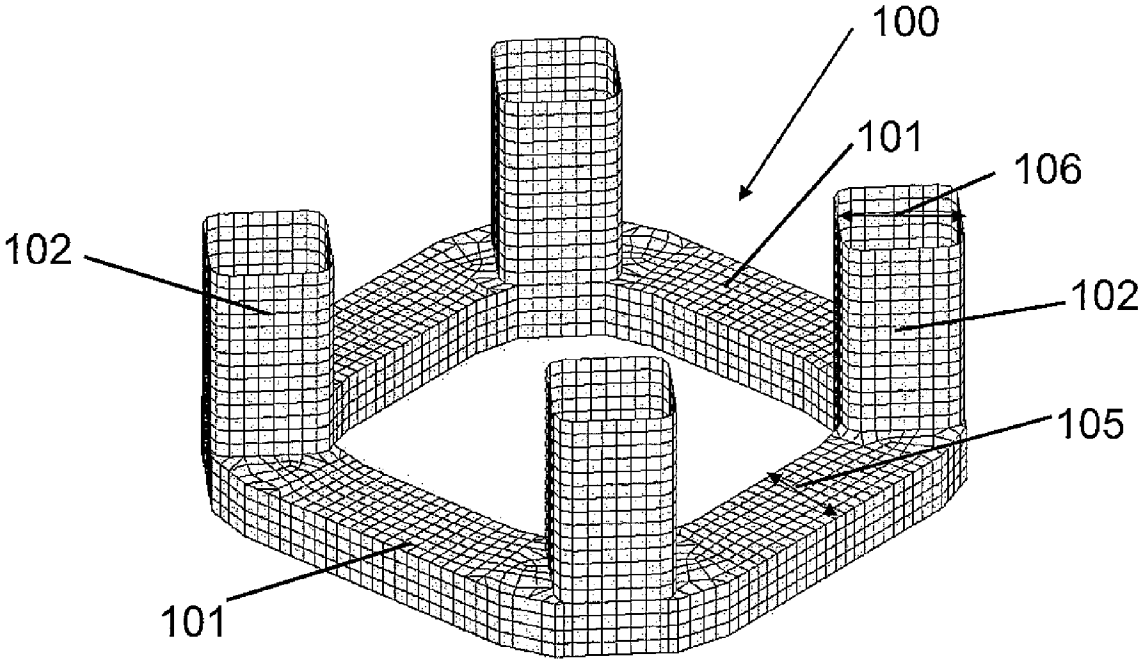
FIG. 11 is a perspective view of a C-Semi with straight pontoon middle sections and square columns, according to another embodiment of the present invention.

FIG. 11 is an elevation perspective view of a C-semi 100 according to this embodiment of the present invention. As shown, the four square cylindrical columns 102 with round corners can be coupled to the pontoon 101 at points along the perimeter of the pontoon 101 equidistant from each other.

Figure 12:
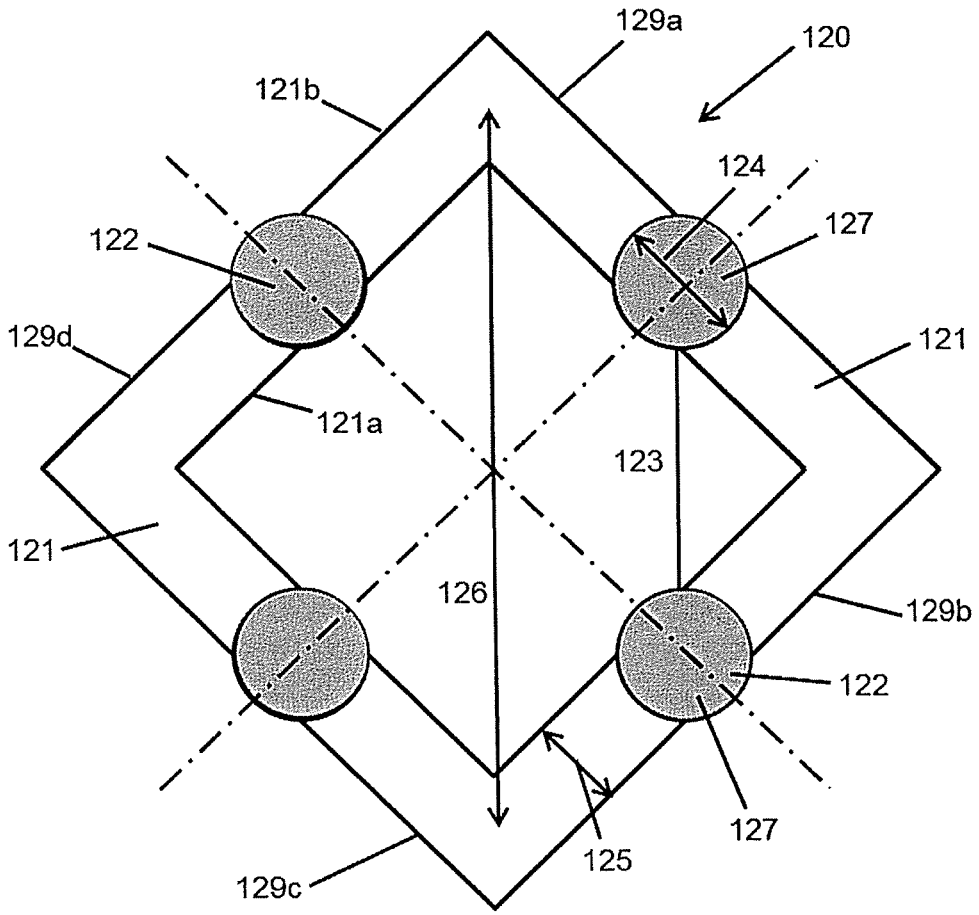
FIG. 12 is a plan view of a C-Semi with a square pontoon and circular columns, according to another embodiment of the present invention.

FIG. 12 is a plan view of a C-Semi 120 according to another embodiment of the present invention. As shown, the four circular columns 122 can be coupled to the pontoon 121 at the center of each side of the pontoon 121. The pontoon 121 is a hollow rectangular cuboid with an interior edge 121*a* and an exterior edge 121*b*.

While the pontoon 121 may be a single structure or several separate structures, for ease in description, the pontoon 121 will be referred to as having four sections or quadrants 129*a*, 129*b*, 129*c* and 129*d*; each section is coupled to two adjacent columns 122. The maximum width (in this case the diameter) of the columns 122 is larger than the width 125 of the pontoon 121. Therefore, at the point where the column 122 intersects the pontoon 121, the cross-sectional area of each column 122 is greater than the corresponding area of the pontoon 121. In this embodiment, as shown, parts of each column 122 extend radially beyond the interior edge 121*a* and exterior edge 121*b*.

The pontoon sections are positioned radially outward relative to the columns. The diameter 126 from the center of the radial width of one pontoon section 129*a* to the center of the radial width of an opposite pontoon section 129*c* is preferably between 1.2 to 1.5 times the distance 123 from the center of one column 127 to the center of an adjacent column 127. The pontoon sections are substantially longer relative to the column width 124, and the distance 123 between central axes of adjacent columns is preferably 3.5 to 4 times the column width 124. The preferred draft is generally between 20 to 50 meters. The draft is between 0.3 and 1 times the distance 123 from the center of one column 122 to the center of an adjacent column 122. The draft is also typically much less than the distance 123 between central axes of adjacent columns. The pontoon width 125 varies from 0.6 to 1 times the column width 124. The preferred pontoon height is in the range of 0.4 to 0.8 times the pontoon width 125. The column displacement is between 0.8 to 2 times the pontoon displacement. The wave forces on the columns contribute less than the force on the pontoon for most wave periods.

Figure 13:
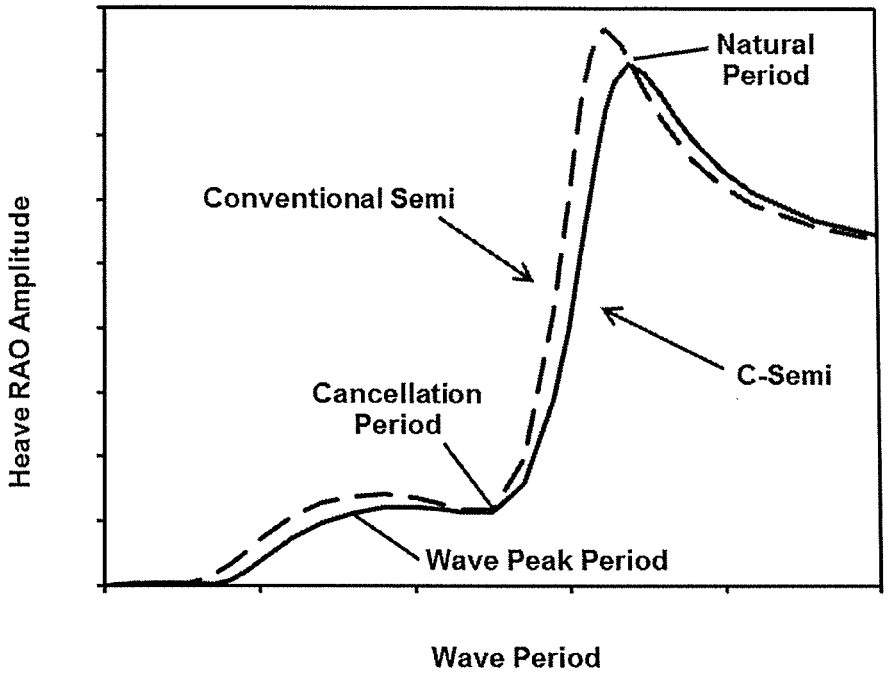
FIG. 13 is a graph displaying the heave response amplitude operators (RAO) for a C-Semi (as embodied in FIG. 3) and conventional semi-submersible hull both at the same draft.
Figure 14:
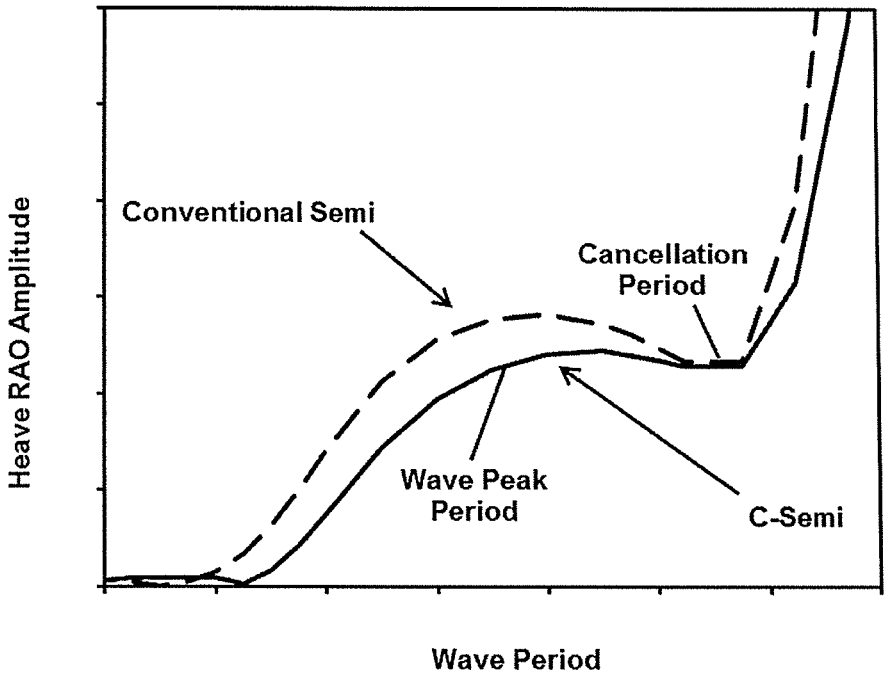
FIG. 14 is a graph displaying the heave response amplitude operators (RAO) around wave peak period for a C-Semi (as embodied in FIG. 3) and conventional semi-submersible hull both at the same draft.

A C-Semi with a circular cylindrical ring pontoon and straked columns is beneficial because the structure minimizes hydrodynamic and structural forces. FIG. 13 is a graph of heave response amplitude operators for a C-Semi according to the embodiment shown in FIG. 3 and a conventional semi-submersible hull at the same draft. FIG. 14 is a graph showing a detailed view around the wave peak period (Tp) in FIG. 13. The graphs show that the C-Semi minimizes hydrodynamic loading around both the wave peak period and the natural period through cancellation and redistribution of wave excitation forces on pontoon and columns. Specifically, the C-Semi reduces heave motions by 20% to 30% in extreme hurricane conditions when compared to a conventional semi-submersible hull at the same draft. The C-Semi reduces heave motions by 40% to 50% in fatigue sea states.

Figure 15:
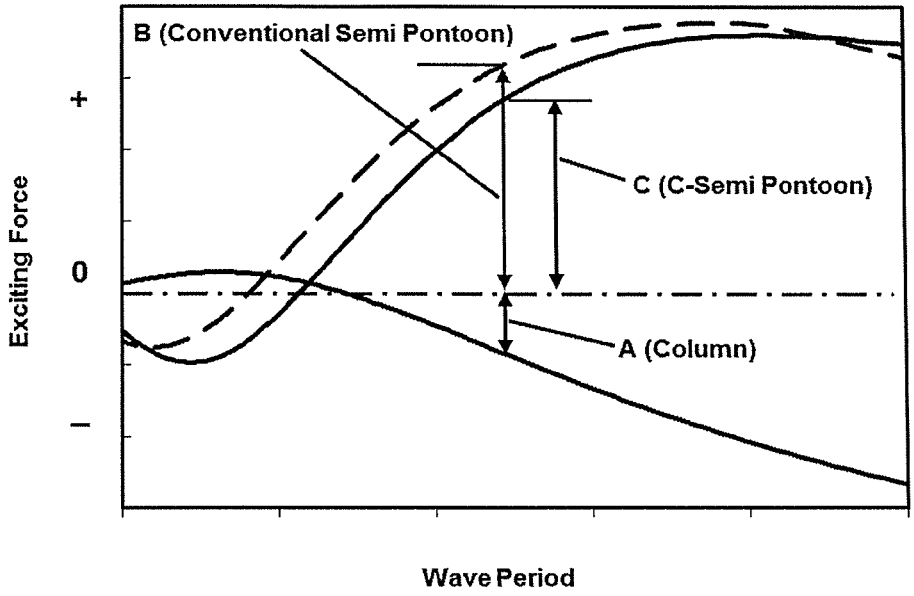
FIG. 15 is a graph displaying the wave exciting forces on the pontoon and columns in the vertical direction for a C-Semi (as embodied in FIG. 3) and a conventional semi-submersible hull both at the same draft.

FIG. 15 is a graph of wave exciting forces on the pontoon and columns in the vertical direction corresponding to FIG. 14. The C-Semi and conventional semi-submersible hulls have the same draft, column width, and distance between central axes of adjacent columns, and thus the same wave exciting force on columns, A. According to preferred embodiments of the present invention, the wave exciting force on the C-Semi pontoon, C, is noticeably less than the wave exciting force of the conventional semi-submersible pontoon, B, for a dominant wave peak period. Since the wave forces on the pontoon and columns act in the opposite direction, the total force on the C-Semi, C-A, is more significantly reduced than the conventional semi-submersible, B-A.

A C-Semi also minimizes vortex induced motion (VIM) by mitigating current flows through strakes. In comparison to a conventional semi-submersible hull, the C-Semi reduces VIM amplitude by 50% or more and riser fatigue damage by 80% in current sea states. The C-Semi structure also reduces VIM induced mooring and riser tension and fatigue damage. The C-Semi structure may offer additional benefits by minimizing current forces.

Furthermore, the C-Semi minimizes structural forces. In comparison to a conventional semi-submersible hull, the C-Semi reduces structural forces and stress concentrations by eliminating the sharp corners between the pontoon sections.

Thus, the preferred embodiments have been fully described above. Although the invention has been described based upon these preferred embodiments, it would be apparent to those of skill in the art that certain combinations, modifications, variations, and alternative constructions could be made to the described embodiments within the spirit and scope of the invention.

The invention claimed is:

1. An offshore floating structure for the drilling and production of oil and gas, said offshore floating structure comprising:

a generally circular toroidal, hollow pontoon of substantially a same radial width throughout a perimeter of the pontoon; and a plurality of columns of substantially a same cross-sectional area, each coupled, at a coupling point, on a bottom end thereof to said pontoon at an equidistant point along the perimeter of said pontoon, and adapted to be coupled on a top end to a deck structure;

wherein a diameter from a center of the radial width of said pontoon is greater than a distance from a center of one said column to a center of an adjacent said column; and wherein at least one of:

said distance from the center of one said column to the center of an adjacent said column is between 3.5 to 4 times as great as the width of one of said column, or a draft is between 0.3 to 1 times said distance from the center of one said column to the center of an adjacent said column.

2. The offshore floating structure recited in claim 1, wherein:

said generally circular toroidal, hollow pontoon has linear and non-linear portions;

wherein said non-linear portions are nearest to said coupling points of said pontoon with said columns and said linear portions are located at a center point between said coupling points.

3. The offshore floating structure recited in claim 1, wherein:

at said coupling points of said pontoon with said columns, the cross-sectional area of each column is greater than a corresponding area of said pontoon.

4. The offshore floating structure recited in claim 1, wherein:

said columns extend radially beyond both interior and exterior edges of said pontoon.

5. The offshore floating structure recited in claim 1, wherein:

said columns extend radially beyond only an interior or an exterior edge of said pontoon.

6. The offshore floating structure recited in claim 1, wherein:

said columns are three, four, five, or six in number.

7. The offshore floating structure recited in claim 1, wherein:

said diameter from a center of said radial width of said pontoon is 1.2 to 1.5 times said distance from a center of one said column to a center of an adjacent said column.

8. An offshore floating structure for the drilling and production of oil and gas, said offshore floating structure comprising:

a hollow, oval toroidal pontoon of substantially a same radial width throughout a perimeter of the pontoon; and four large columns of substantially a same cross-sectional area, each coupled on a bottom end thereof to said pontoon at an equidistant point along the perimeter of said pontoon forming two non-shortest diameters, and adapted to be coupled on a top end to a deck structure; and two small columns of substantially a same cross-sectional area, each coupled on a bottom end thereof to said pontoon at an equidistant point along the perimeter of said pontoon forming a shortest diameter, and adapted to be coupled on a top end to a deck structure.

9. The offshore floating structure recited in claim 1, wherein:

said columns have a cross-sectional area that is circular or square with rounded corners.

10. The offshore floating structure recited in claim 1, wherein:

said columns are provided with strakes.

* * * * *